US006385428B1

(12) United States Patent
Uchida et al.

(10) Patent No.: US 6,385,428 B1
(45) Date of Patent: May 7, 2002

(54) SELF-CLEANING IMAGE FORMING APPARATUS

(75) Inventors: Michio Uchida; Hideyuki Yano; Masatake Usui, all of Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/656,476

(22) Filed: Sep. 6, 2000

(30) Foreign Application Priority Data

Sep. 7, 1999 (JP) ..... 11-252968
Jul. 11, 2000 (JP) ..... 2000-209753

(51) Int. Cl.[7] ..... G03G 15/16

(52) U.S. Cl. ..... 399/303; 399/101; 399/302; 399/308

(58) Field of Search ..... 399/101, 71, 66, 399/302, 303, 308, 314, 343

(56) References Cited

U.S. PATENT DOCUMENTS 5,179,397 A 1/1993 Ohzeki et al. ..... 347/140
5,196,885 A 3/1993 Takeuchi et al. ..... 399/168
5,223,900 A 6/1993 Yuminamochi et al. ..... 399/313
5,621,509 A * 4/1997 Karashima et al. ..... 399/66 X
5,758,038 A * 5/1998 Itoh et al. ..... 399/101 X
5,809,373 A * 9/1998 Yoda et al. ..... 399/101
5,899,610 A 5/1999 Enomoto et al. ..... 399/302
5,995,793 A 11/1999 Enomoto et al. ..... 399/302
6,097,919 A 8/2000 Takeuchi et al. ..... 399/298

FOREIGN PATENT DOCUMENTS

JP 2000-155447 * 6/2000

* cited by examiner

*Primary Examiner*—Sophia S. Chen
(74) *Attorney, Agent, or Firm*—Fitzpatrick, Cella, Harper & Scinto

(57) ABSTRACT

When a cleaner is included exclusively for cleaning a transfer/transport belt to remove toner therefrom, the structure of an image forming apparatus becomes complex and the costs thereof increase. The present invention attempts to remedy this situation. Specifically, a difference between a peripheral speed relative to the transfer/transport belt to be set for cleaning and a peripheral speed relative to photosensitive drums to be set therefor is made larger than that between peripheral speeds to be set for ordinary image formation. Because of this constituent feature, unnecessary toner on the transfer/transport belt is efficiently transferred onto the photosensitive drums on a stable basis for a short period of time.

74 Claims, 5 Drawing Sheets

SELF-CLEANING IMAGE FORMING APPARATUS

BACKGROUND OF THE INVENTION

1. Field of the Invention

The present invention relates to an image forming apparatus using electrophotography, such as, for example, a copier, a printer, or a facsimile system.

2. Description of the Related Art

In recent years, image forming apparatuses including an electrophotography apparatus have been upgraded in pursuit of high-speed processing, full-fledge functionality, and advanced color capability. Various types of printers and copiers have been placed on the market.

Above all, an in-line image forming apparatus capable of forming color images at a high speed is expected to become the mainstream of color printers in the future. The in-line image forming apparatus has a plurality of image forming means, each of which handles a different color, arranged in series with one another, and successively transfers toner images to superimpose them on one another. The in-line image forming apparatus falls into two types. Referring to FIG. 4, one type of in-line image forming apparatus transfers color toner images successively from photosensitive drums 109M, 109C, 109Y, and 109K onto a transfer medium 101, which is borne and transported by a transfer/transport belt 107, and thusly superimpose the images on one another to produce a color image. Referring to FIG. 5, the other type of in-line image forming apparatus first transfers color toner images successively from the photosensitive drums 109M, 109C, 109Y, and 109K onto an intermediate transfer belt 150. The in-line image forming apparatus then transfers the plurality of color toner images transferred onto the intermediate transfer belt 150 onto the transfer medium 101 all together, and thus produces a color image.

In the image forming apparatus having the transfer/transport belt 107 or intermediate transfer belt 150, when unnecessary toner remains and adheres to the surface of the belt, it causes the back of the transfer medium 101 to be soiled. This also causes images produced by the apparatus to be stained. Specifically, toner adheres to the transfer/transport belt 107 or intermediate transfer belt 150 during a sequence of steps of transferring a color mismatch detection toner image or a density detection toner image from the photosensitive drum to the transfer/transport belt 107 or intermediate transfer belt 150, and then checking the toner image. The sequence is carried out in order to control paper jams, fog-causing adhesions of toner to non-image portions, color mismatches, and toner density.

The toner remaining or adhering to the transfer/transport belt 107 or intermediate transfer belt 150 is removed by cleaning means (cleaning blades) 160 and 170.

However, according to a conventional cleaning method for removing toner that remains or adheres to the transfer/transport belt 107 or intermediate transfer belt 150, a waste toner container used to collect waste toner removed by the cleaning means 160 and 170 is necessary. The waste toner container is needed separately from a waste toner container used by cleaning means 114M, 114C, 114Y, and 114K for removing toner remaining on the photosensitive drums 109M, 109C, 109Y, and 109K. This results in a large-sized cleaning unit and necessitates the complex structure of the apparatus, thereby leading to an increase in the cost of the apparatus, thereby leading to an increase in the cost of the apparatus.

SUMMARY OF THE INVENTION

Accordingly, an object of the present invention is to provide an image forming apparatus capable of removing toner from a transfer medium bearer so as to clean the transfer medium bearer.

Another object of the present invention is to provide an image forming apparatus capable of removing toner from an intermediate transfer member so as to clean the intermediate transfer member.

Further objects, features and advantages of the present invention will become apparent from the following description of the preferred embodiments with reference to the attached drawings.

In accordance with the above objects, there is provided an image forming apparatus, including a movable image bearing member for bearing a toner image and a movable transfer medium bearing member for bearing a transfer medium. A toner image borne by the image bearing member is transferred onto a transfer medium borne by the transfer medium bearing member at a transfer position. The difference between the moving speed at which the image bearing member passes through the transfer position and the moving speed at which the transfer medium bearing member passes through the transfer position when the toner image is transferred from the image bearing member onto the transfer medium is unequal to the difference in moving speeds when toner on the transfer medium bearing member is transferred onto the image bearing member. The inequality of these differences enables the apparatus to have improved cleaning efficiency as well as improved image transfer efficiency.

The aforementioned differences in moving speed, or the moving speeds themselves, may vary according to whether the image bearing member or the transfer medium bearing member is passing through the transfer position. The mathematical relationship between these moving speeds may conform to one of several inequalities. The difference may be substantially zero when the toner image on the image bearing member is transferred onto the transfer medium.

The image forming apparatus may also include a transferring means for transferring the toner image on the image bearing member onto the transfer medium. The transferring means may also be used for transferring toner on the transfer medium bearing member onto the image bearing member.

The image bearing member may include several image bearing elements. Images on the image bearing elements may successively be transferred onto the transfer medium, thus superimposing the images upon one another. An electric field induced for transferring toner from the transfer medium bearing member onto the first image bearing element may have a direction that is opposite to the direction of an electric field induced for transferring toner from the transfer medium bearing member onto the second image bearing element.

The image forming apparatus may also include a collecting means for collecting toner from the image bearing member.

In another embodiment of the present invention, an image forming apparatus includes a movable image bearing member for bearing a toner image and a movable intermediate transfer member. A toner image borne by the image bearing member is transferred onto the intermediate transfer member at a transfer position, and then the toner image is transferred from the intermediate transfer member onto a transfer medium. The difference between the moving speed at which the image bearing member passes through the transfer position and the moving speed at which the intermediate transfer member passes through the transfer position when the toner image is transferred from the image bearing member onto the intermediate transfer member is unequal to the difference in moving speeds when toner on the intermediate transfer medium is transferred onto the transfer medium.

DESCRIPTION OF THE PREFERRED EMBODIMENTS

First Embodiment

Figure 1:
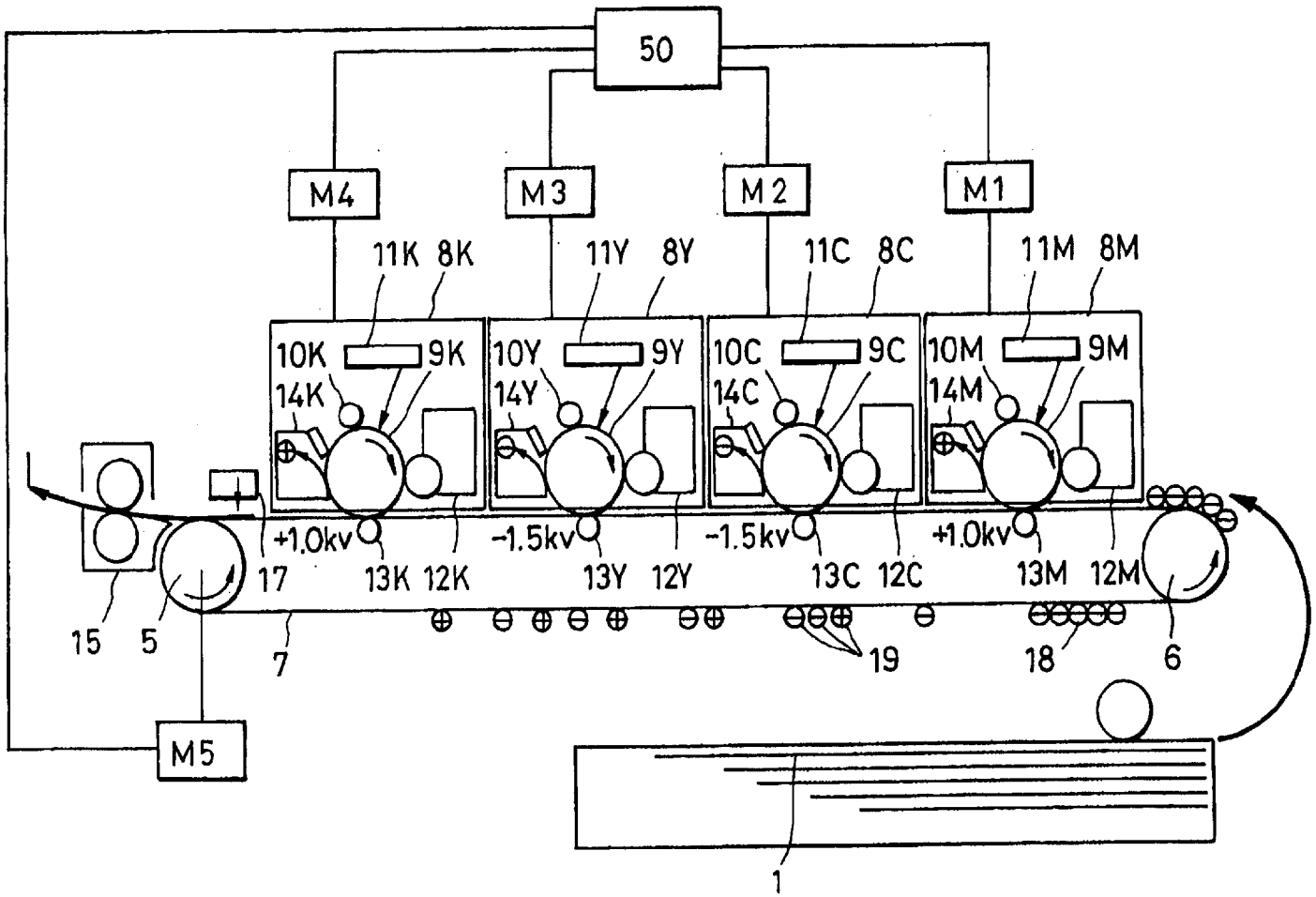
FIG. 1 schematically shows the structure of an image forming apparatus in accordance with the first embodiment.

FIG. 1 schematically shows the structure of an image forming apparatus in accordance with the present embodiment.

Image forming stations 8M, 8C, 8Y, and 8K are juxtaposed in a manner corresponding to the direction of movement of a transfer/transport belt 7 serving as a transfer medium bearing member. (The M, C, Y, and K correspond to the respective colors of the image forming stations: M=magenta, C=cyan, Y=yellow, and K=black.) Part of each image forming station (including at least a photosensitive drum and a cleaning unit) is attachable or detachable to or from a main unit of the image forming apparatus in the form of a process cartridge. A photosensitive drum 9M serving as an image bearing member is included in the image forming station 8M. Moreover, a primary electrification roller 10M, an exposure unit 11M, a developer 12M, and a cleaning unit (including a cleaning blade and a waste toner container) 14M are arranged within the image forming station 8M in an operational order corresponding to the direction of rotation in which the photosensitive drum 9M rotates. In the other image forming stations 8C, 8Y, and 8K, similarly as in the image forming station 8M, a photosensitive drum, a primary electrification roller, an exposure unit, a developer, and a cleaning unit are included.

The transfer/transport belt 7 is laid over a drive roller 5 and a driven roller 6. The drive roller 5 is driven to rotate by a drive motor (for example, a stepper motor) that is not shown. The rotational driving force propagates from the drive roller 5 to the transfer/transport belt 7. The direction of movement of the photosensitive drums 9M, 9C, 9Y, 9K located at respective transfer positions is substantially identical to the direction of movement of the transfer/transport belt 7.

Next, an image formation process will be described. When an image formation start signal is received, the transfer/transport belt 7 and the photosensitive drums 9M to 9K start rotating. At this time, the transfer/transport belt 7 comes into contact with the photosensitive drums 9M to 9K. The surface of the photosensitive drum 9M is electrified to assume a desired potential using the primary electrification roller 10M (a negative potential in the present embodiment). The electrified surface of the photosensitive drum 9M is exposed based on image information by means of the exposure unit 11M, whereby an electrostatic latent image is formed. The electrostatic latent image formed on the photosensitive drum 9M is developed with a magenta toner (toner characteristic of being negatively electrified) by means of the developer 12M. A magenta toner image is then formed on the photosensitive drum 9M. The magenta toner image is transferred to a transfer medium 1, which is borne by the transfer/transport belt 7 and fed according to the timing of the magenta toner image, by means of a transfer roller 13M serving as a transferring means. At this time, a predetermined voltage (positive voltage in the present embodiment) is applied from a transfer power supply to the transfer roller 13M.

The foregoing image formation and transfer steps are repeated relative to the other image forming stations 8C, 8Y, and 8K. A cyan toner image, a yellow toner image, and a black toner image formed on the photosensitive drums 9C to 9K are successively transferred onto a transfer medium 1 as it is transported by the transfer/transport belt 7, and superimposed on one another. Thereafter, the transfer medium 1 is separated from the transfer/transport belt 7. The toner images are heated, pressured, and fixed onto the transfer medium 1 by means of a fixer 15. The transfer medium 1 having the images fixed thereto is then ejected out from the image forming apparatus. Thus, the image formation process is completed.

After the toner images are transferred from the photosensitive drums 9M, 9C, 9Y, 9K to the transfer medium 1, residual toner remaining on the photosensitive drums is removed from the photosensitive drums by the cleaning units 14M, 14C, 14Y, 14K and collected in the waste toner containers.

According to the present embodiment, the density of toner in a toner image formed on a photosensitive drum may vary as a function of time and/or depending on the temperature or humidity in the apparatus. A density detection toner image 18 is formed with toner of a predetermined density on each of the photosensitive drums, and transferred onto the transfer/transport belt 7. The density of toner in the density detection toner image 18 is then checked using an optical density sensor 17. An electric signal proportional to the density detected by the optical density sensor 17 is sent to a control unit (CPU 50). The control unit controls an amount of toner to be fed to the corresponding developer 12. This density control sequence is carried out for each image forming station.

According to the present embodiment, color toner images may be improperly superimposed on one another on the transfer member; in other words, the color toner images may be mismatched. This is attributable to an error in dimensions occurring during assembling of components, replacement of a transfer/transport belt unit including the transfer/transport belt 7, or replacement of a process cartridge. For preventing such a mismatch, a color mismatch control sequence may be carried out at intervals of a predetermined period or according to predetermined timing. First, a predetermined toner image intended to control a color mismatch is formed on each photosensitive drum, and transferred onto the transfer/transport belt 7. The sensor 17 (e.g., a charge-coupled device (CCD) or the like) checks the transferred image and sends a signal to the control unit. This sequence is carried out for each image forming station. The control unit judges the degree of a color mismatch, and controls the timing of starting image formation at each image forming station.

Next, a description will be made of a cleaning method for removing toner that adheres to the transfer/transport belt 7 and causes a fog, the density detection toner image, and the color mismatch control toner image.

According to the present embodiment, unnecessary toner on the transfer/transport belt 7 is electrostatically transferred onto the photosensitive drums 9. The inversely transferred unnecessary toner is collected into the cleaning units 14 associated with the respective photosensitive drums 9.

The performance of toner may greatly vary as a function of time or depending on the temperature or humidity in the apparatus. Namely, with the passage of time, the diameter of particles of toner decreases or the liability to electrification thereof deteriorates. Consequently, the toner becomes unsusceptible to an electric field. This may invite degradation of cleaning efficiency and cause imperfect cleaning. Moreover, when a paper jam occurs or when the density detection toner image or color mismatch control toner image is transferred onto the transfer/transport belt 7, the amount of toner is much larger than a normal amount of toner, thereby causing a stain. The transfer/transport belt 7 must be rotated many turns in order to complete the cycle of transferring toner from the transfer/transport belt 7 to each photosensitive drum 9 and collecting it into each waste toner container. This is time-consuming. Additionally, deterioration of one or more components may occur (for example, the service lives of the photosensitive drum and transfer/transport belt may be shortened).

Moreover, unnecessary toner adhering to the transfer/transport belt 7 consists of toners 19 of positive and negative polarities. According to the present embodiment, the respective polarities of the voltages to be applied to transfer rollers 13M, 13C, 13Y, and 13K are reversed appropriately, and toner is transferred to the photosensitive drums 9M, 9C, 9Y, and 9K. Cleaning is thus achieved. During the cleaning, a voltage of positive polarity is applied to the transfer rollers 13M and 13K, and a voltage of negative polarity is applied to the transfer rollers 13C and 13Y. Toner electrified mainly positively is transferred onto the photosensitive drums 9M and 9K, while toner electrified mainly negatively is transferred onto the photosensitive drums 9C and 9Y.

More specifically, a voltage of 1.0 kV whose polarity (positive polarity in the present embodiment) is the same as that of a voltage to be applied for ordinary image formation is applied to the transfer roller 13M. Toner whose polarity has become opposite to the polarity exhibited by normally electrified toner is transferred onto the photosensitive drum 9M and collected into the waste toner container included in the cleaning unit 14M. At this time, toner not transferred onto the photosensitive drum 9M but passed through it may contain toner whose polarity has been reversed. The polarity of a voltage to be applied to the transfer roller 13M is made opposite to the polarity exhibited by normally electrified toner. This is because unnecessary toner on the transfer/transport belt 7 contains only a small amount of toner electrified to exhibit positive polarity. Because of this the constituent feature, the collection of a majority of unnecessary toner into the waste toner container included in the cleaning unit 14M is prevented. This allows the replacement interval for the process cartridge 8M to be commensurate with that of the other process cartridges.

Thereafter, a voltage of −1.5 kV whose polarity is opposite to that of a voltage to be applied for ordinary image formation (positive polarity in the present embodiment) is applied to the transfer roller 13C. Negatively electrified toner that has not been collected using the photosensitive drum 9M is thus transferred onto the photosensitive drum 9C and collected into the waste toner container included in the cleaning unit 14C. However, when an amount of unnecessary toner on the transfer/transport belt 7 is large, all of the negatively electrified toner cannot be collected. Thereafter, toner remaining on the transfer/transport belt 7 consists of negative toner that has not been collected and toner that is electrified to exhibit polarity (positive polarity) opposite to the polarity exhibited by normally electrified toner while passing through the photosensitive drum 9C and transfer roller 13C.

Likewise, a voltage of −1.5 kV whose polarity is opposite to that of a voltage to be applied for ordinary image formation (positive polarity in the present embodiment) is applied to the transfer roller 13Y. Negatively electrified toner that has not been collected using the photosensitive drum 9C is transferred onto the photosensitive drum 9Y and collected into the waste toner container included in the cleaning unit 14Y. Unnecessary negatively electrified toner on the transfer/transport belt is nearly entirely collected. Thereafter, only a small amount of positively electrified toner remains on the transfer/transport belt 7.

A voltage of 1.0 kV whose polarity is the same as that of a voltage to be applied for ordinary image formation (positive polarity in the present embodiment) is applied to the transfer roller 13K. Toner exhibiting (positive) polarity opposite to the polarity exhibited by normally electrified toner, which has not been transferred onto the photosensitive drums 9M, 9C, and 9Y but has remained on the transfer/transport belt 7, is transferred onto the photosensitive drum 9K and collected into the waste toner container included in the cleaning unit 14K. Thus, the removal of unnecessary toner so as to clean the transfer/transport belt 7 is complete.

As mentioned above, while the transfer/transport belt 7 is rotated one turn, unnecessary toners exhibiting positive and negative polarities and remaining on the transfer/transport belt 7 can be efficiently collected into the waste toner containers included in the cleaning units 14M, 14C, 14Y, and 14K via the photosensitive drums 9M, 9C, 9Y, and 9K for a short period of time. This obviates the inclusion of a cleaning unit (i.e., a cleaning blade and a waste toner container) dedicated to the transfer/transport belt 7. The degree of freedom in designing the apparatus is raised, and the number of waste toner containers is decreased. Consequently, the number of components to be replaced with new ones by a user is decreased.

For ordinary image formation, a peripheral speed of the transfer/transport belt 7 passing through each transfer position and that of the corresponding photosensitive drum 9 passing through the transfer position do not fully equate with each other because of the uncertainty in mechanical precision of each component. Herein, the transfer position is a position at which each photosensitive drum and the transfer/transport belt come into contact with each other with the transfer medium between them. Preferably, the peripheral speed of the transfer/transport belt 7 passing through the respective transfer positions and the peripheral speed of each of the photosensitive drums 9M to 9K should be somewhat different from each other. This would prevent the phenomenon of a transferred toner image having a blank in the center thereof, or would ensure a safe transporting speed at which the transfer/transport belt 7 transports the transfer medium. In this case, the possibility that a toner image transferred onto the transfer medium will look stretched in comparison with an original image must be prevented. Likewise, the possibility that toner will be fused to adhere to the photosensitive drum or transfer/transport belt must also be prevented. For these purposes, the ratio of the difference between the peripheral speed (A) of the photosensitive drum and the peripheral speed (B) of the transfer/transport belt to the peripheral speed (A), (B−A)+A×100(%), should preferably be equal to or less than 3%. Depending on the apparatus, the difference in peripheral speed between the photosensitive drum and the transfer/transport belt may not always be preserved but may be nil.

According to the present embodiment, the difference between the peripheral speed of the transfer/transport belt 7 and the peripheral speed of the photosensitive drums 9M, 9C, 9Y, and 9K is set to a larger value for cleaning than the value for ordinary image formation. Incidentally, the peripheral speed of the transfer/transport belt 7 is higher than that set for ordinary image formation. Because of this constituent feature, toner on the transfer/transport belt 7 for which liability to electrification has deteriorated or a density detection toner image or color mismatch control toner image that has layered or transferred on or onto the transfer/transport belt 7 because of a paper jam can be efficiently transferred onto the photosensitive drum 9M, 9C, 9Y, and 9K for a short period of time. In short, transfer efficiency can be improved, and cleaning efficiency can be improved.

Figure 3:
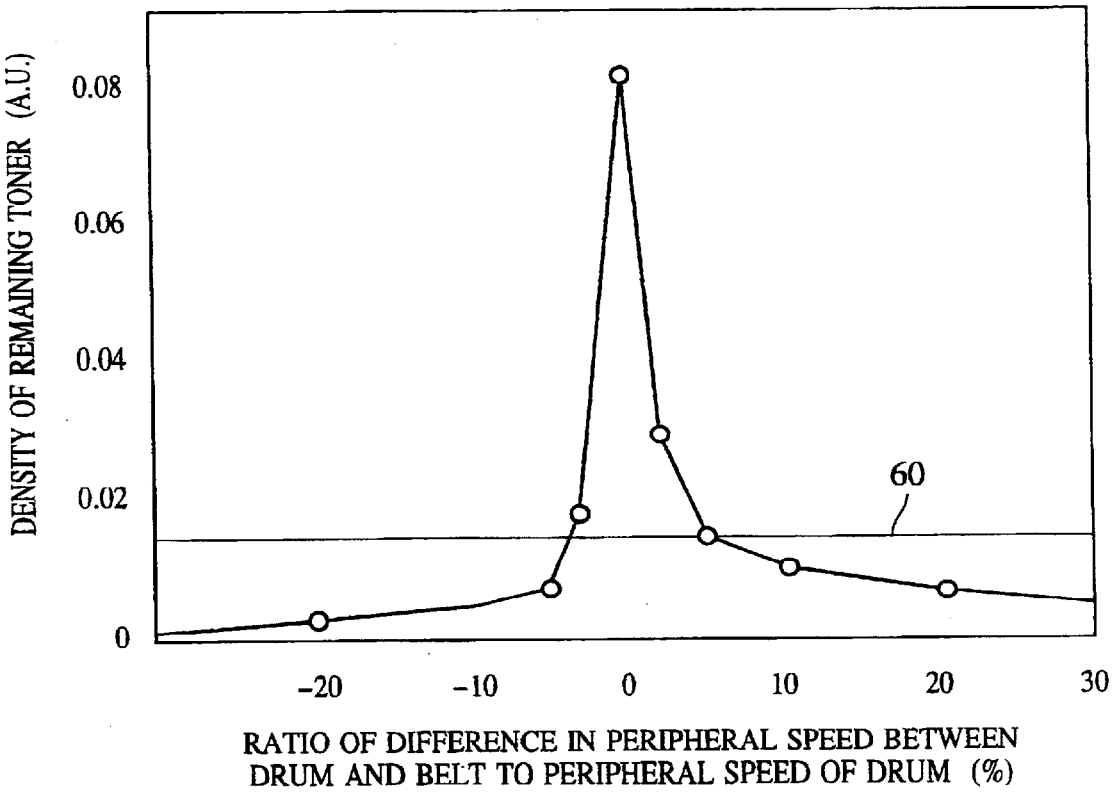
FIG. 3 shows a graph of the ratio of the difference in peripheral speed between a drum and a belt to the peripheral speed of the drum as a function of the density of remaining toner.
Figure 4:
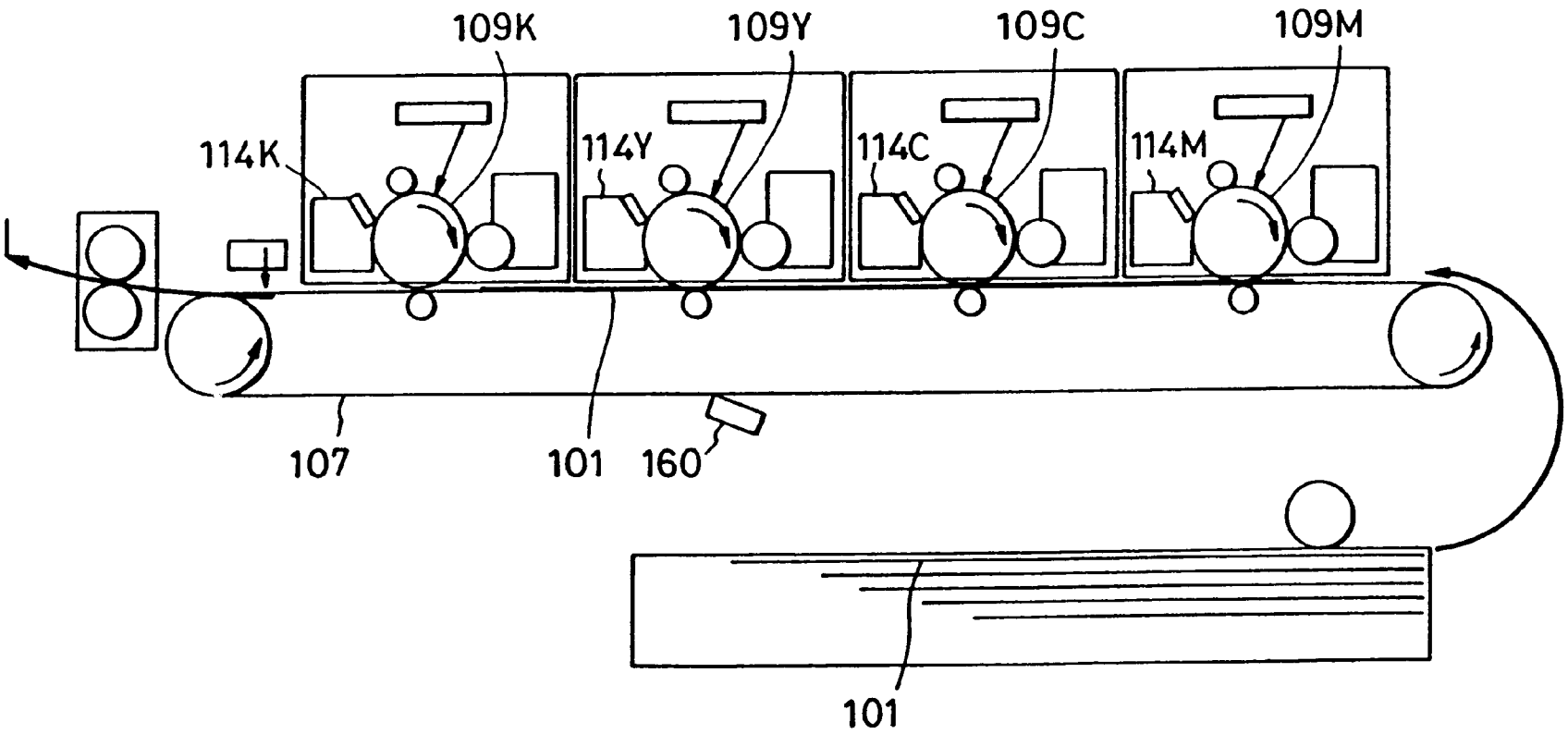
FIG. 4 (PRIOR ART)
FIG. 4 schematically shows the structure of a conventional image forming apparatus.
Figure 5:
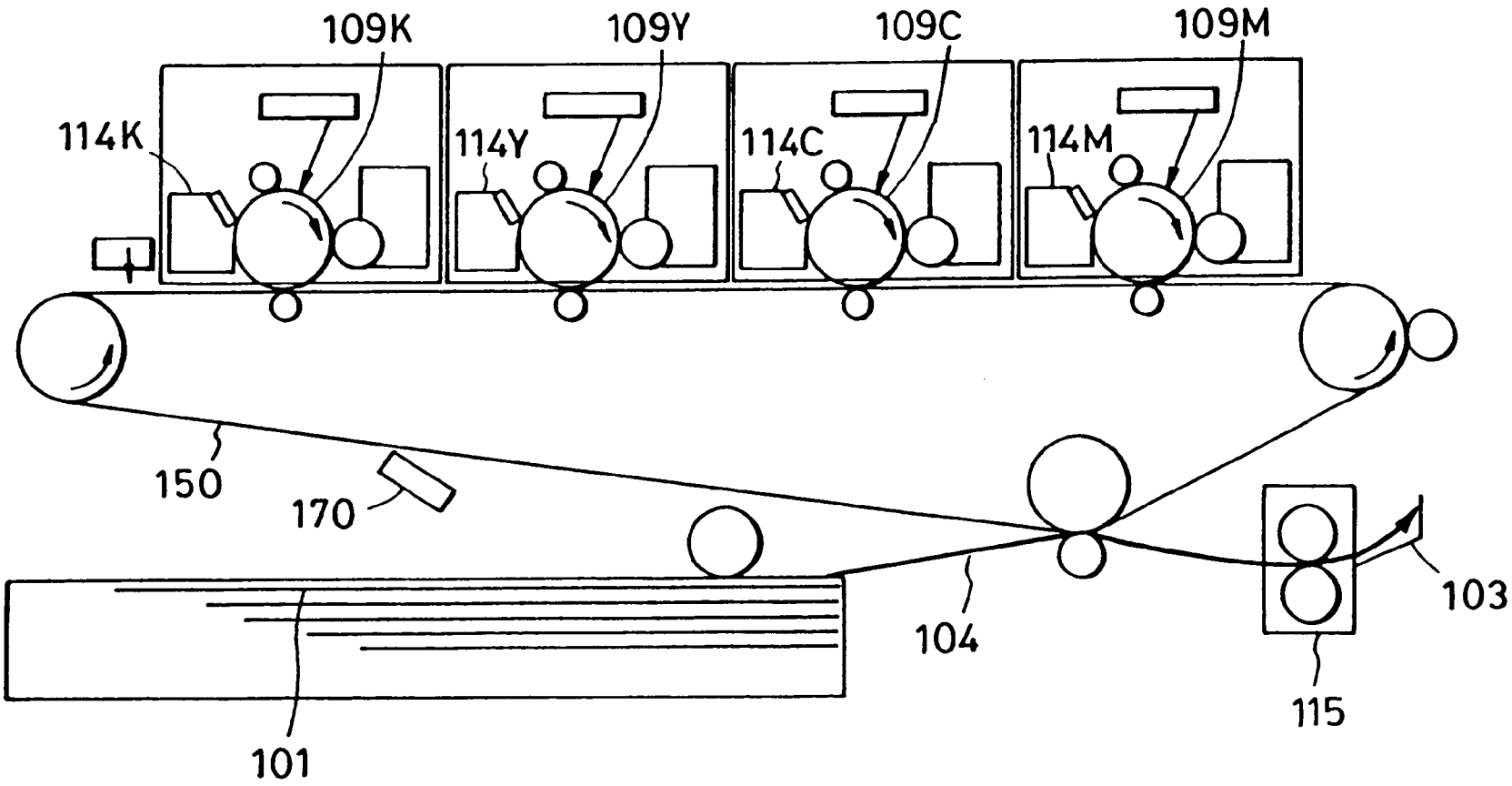
FIG. 5 (PRIOR ART)
FIG. 5 schematically shows the structure of another conventional image forming apparatus.

FIG. 3 shows the relationship between the foregoing ratio and the density of toner remaining on the transfer/transport belt 7 after the aforesaid cleaning sequence is carried out by rotating the transfer/transport belt 7 one turn. A border line 60 drawn in FIG. 3 indicates a threshold. When the density of toner remaining on the transfer/transport belt 7 falls below the threshold, the toner density is negligible in practice. This means that cleaning has been achieved properly.

In contrast, for efficiently removing unnecessary toner so as to clean the transfer/transport belt 7 on a stable basis for a short period of time, the aforesaid ratio should preferably be set to at least 6%. For achieving cleaning more efficiently, the ratio should preferably be set to 10% or more.

Moreover, according to the present embodiment, since abrasion of the surfaces of the photosensitive drums and transfer/transport belt 7 progresses to become significant, the aforesaid ratio should preferably be set to 200% or less.

The peripheral speeds of the transfer/transport belt 7 and photosensitive drum 9 vary greatly between ordinary image formation and cleaning. The cleaning sequence is therefore carried out during a period from the instant the ordinary image formation is completed to the instant the image formation start signal is applied next, that is, during a so-called after-rotation. Moreover, when either the density control sequence or color mismatch control sequence is carried out, after the sequence is completed, the transfer/transport belt 7 may be cleaned at any time. After the cleaning is completed, the apparatus is brought to a state of waiting for next application of the image formation start signal, that is, a so-called standby mode. According to the present embodiment, drive sources M1 to M4 for rotating the photosensitive drums are included separately from a drive source M5 for rotating the transfer/transport belt.

As mentioned above, for cleaning, the peripheral speed of the photosensitive drum 9 is set to a different value from that of the transfer/transport belt 7. Toner on the transfer/transport belt 7 is forcibly agitated using a frictional force, whereby the effect of a van der Waals force between the transfer/transport belt 7 and the toner is weakened. The toner has nonpolar toner thereof reduced with application of charge by the transfer roller 13. Consequently, the toner becomes susceptible to an electric field. Eventually, cleaning efficiency improves drastically. Cleaning can therefore be achieved highly efficiently on a stable basis for a short period of time.

According to the present embodiment, the transfer roller 13 is employed as a transferring means. Alternatively, a blade, a brush, or a corona electrifier that is a noncontact electrifier may be employed. Preferably, for achieving cleaning efficiently with the transfer/transport belt 7 in close contact with the photosensitive drum 9, a contact electrifier such as a roller, blade, or brush should be adopted as the transferring means.

Second Embodiment

Figure 2:
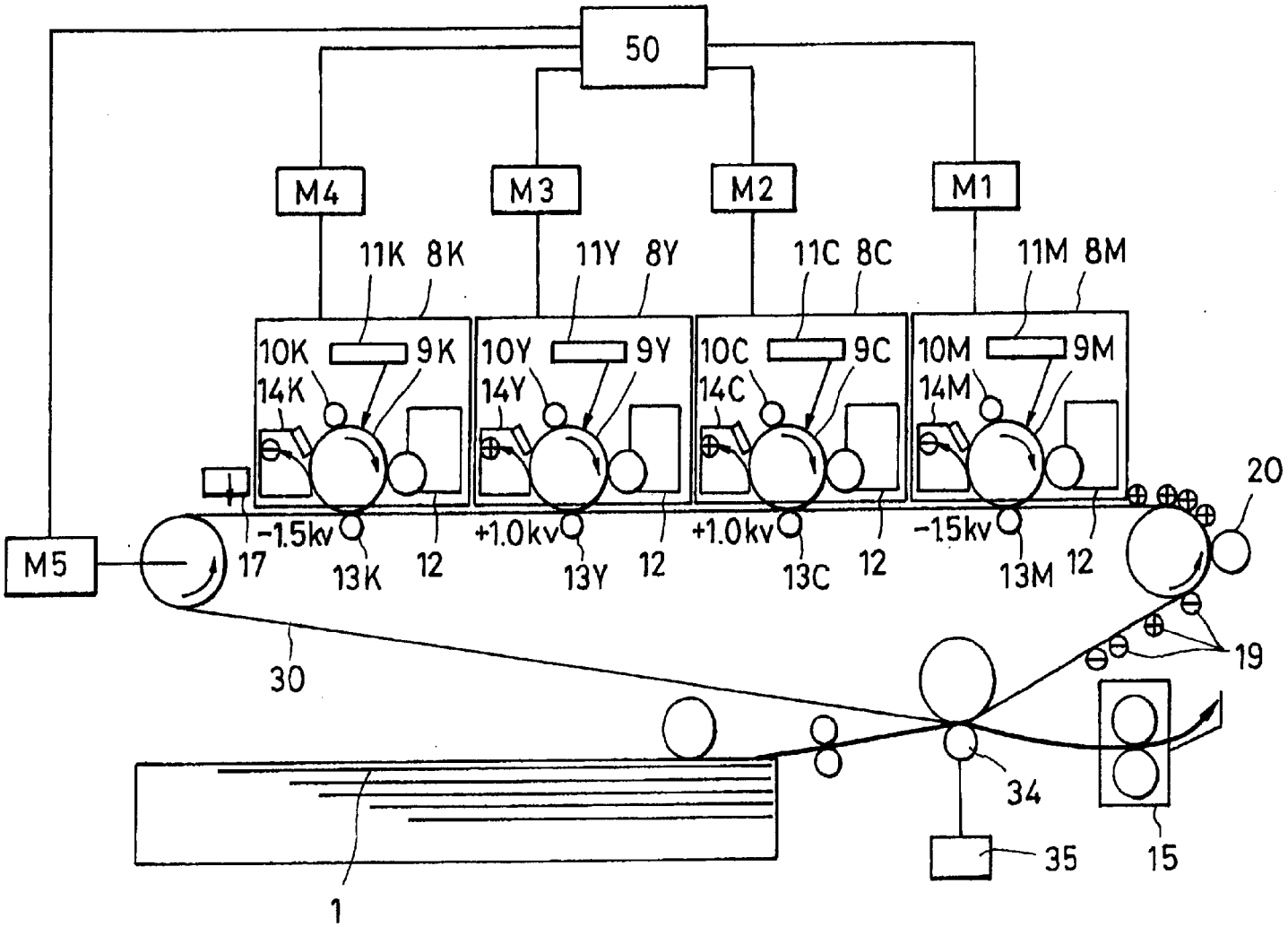
FIG. 2 schematically shows the structure of an image forming apparatus in accordance with the second embodiment.

FIG. 2 schematically shows the structure of an image forming apparatus having an intermediate transfer belt 30 as an intermediate transfer member. The present invention can be applied not only to the image forming apparatus of the first embodiment but also to the image forming apparatus shown in FIG. 2. The same reference numerals will be assigned to members having the same abilities as those shown in FIG. 1, and the description of those members will be omitted.

An image formation process will be briefly described below. When an image formation start signal is applied, the intermediate transfer belt 30 and the photosensitive drums 9M to 9K start rotating. At this time, the intermediate transfer belt 30 comes into contact with the photosensitive drums 9M to 9K. The surface of the photosensitive drum 9M is electrified to a desired potential using the primary electrification roller 10M (negative potential in the present embodiment). The electrified surface of the photosensitive drum 9M is exposed based on image information by means of the exposure unit 11M, and an electrostatic latent image is formed on the photosensitive drum 9M. The electrostatic latent image formed on the photosensitive drum 9M is developed with a magenta toner (toner characteristic of being negatively electrified) by means of the developer 12M, whereby a magenta toner image is formed on the photosensitive drum 9M. The magenta toner image is electrostatically transferred to the intermediate transfer belt 30 by means of the primary transfer roller 13M. At this time, a predetermined voltage (positive voltage in the present embodiment) is applied from a transfer power supply to the primary transfer roller 13M.

The foregoing image formation and transfer steps are repeated relative to the other image forming stations 8C, 8Y, and 8K. A cyan toner image, a yellow toner image, and a black toner image formed on the photosensitive drums 9C to 9K respectively are first transferred successively onto the intermediate transfer belt 30 and superimposed on one another. Thereafter, the plurality of color toner images on the intermediate transfer belt 30 are secondly transferred all together onto the transfer medium 1, which is fed according to predetermined timing, by means of a secondary transfer roller 34. At this time, a predetermined voltage (positive voltage in the present embodiment) is applied from a power supply 35 to the secondary transfer roller 34. Thereafter, the transfer medium 1 is transported to the fixer 15. The toner images are heated, pressured, and fixed onto the transfer medium 1 by means of the fixer 15. The transfer medium 1 having the toner images fixed thereto is then ejected out from the image forming apparatus. The image formation process is thus completed.

Even in the present embodiment, similarly to the transfer/transport belt 7 employed in the first embodiment, the intermediate transfer belt 30 can be cleaned while having unnecessary toner removed therefrom.

Third Embodiment

The present embodiment is nearly identical to the second embodiment. A difference lies in that an electrification roller 20 is included for electrifying unnecessary toner on the intermediate transfer belt 30 shown in FIG. 2 so that the toner will exhibit polarity (positive polarity in the present embodiment) opposite to the polarity exhibited by normally electrified toner. The cleaning sequence for cleaning the intermediate transfer belt 20 employed in the second embodiment is carried out at any time during a period from the instant ordinary image formation is completed to the instant the image formation start signal is applied next, that is, during a so-called after-rotation. When either the aforesaid density control sequence or color mismatch control sequence may be carried out, after the sequence is completed, the cleaning sequence may be carried out at any time. When images are formed consecutively on a plurality of transfer media, toner adhering to a portion of the photosensitive drum 9 not engaged in image formation may adhere to a portion of the intermediate transfer belt 30 between the trailing edge of a toner image transferred from the photosensitive drum 9 thereto and the leading edge of the next toner image (hereinafter referred to as an inter-toner image portion). An object of the present embodiment is to remove such unnecessary toner.

According to the present embodiment, aside from the first cleaning sequence like the one employed in the second embodiment, a second cleaning sequence is added in order to remove toner adhering to the inter-toner image portion of the intermediate transfer belt 30.

The second cleaning sequence will be described below. For forming toner images consecutively on a plurality of transfer media, unnecessary toner on the intermediate transfer belt 30 is positively electrified using the electrification roller 20. The toner is then electrostatically transferred from the intermediate transfer belt 30 onto the photosensitive drum 9M using the primary transfer roller 13M in the image forming station 8M. Simultaneously with the inverse transfer of toner, the next toner image is first transferred from the photosensitive drum 9M onto the intermediate transfer belt 30 using the primary transfer roller 13M. This transfer is achieved electrostatically due to an induced electric field. A voltage whose polarity is opposite to the polarity exhibited by normally electrified toner is applied from a transfer power supply to the primary transfer roller 13M. Because of this constituent feature, when toner images are formed consecutively on a plurality of transfer media, the intermediate transfer belt 30 can be cleaned efficiently while having unnecessary toner removed therefrom without a decrease in throughput of image formation. The second cleaning sequence includes a primary transfer step. Unlike the first cleaning sequence, the difference in peripheral speed between the photosensitive drum 9 and intermediate transfer belt 30 cannot be made large. However, since only a small amount of toner adheres to the inter-toner image portion of the intermediate transfer belt 30, the difference in peripheral speed may be identical to the difference in peripheral speed attained for ordinary image formation. The intermediate transfer belt 30 employed in the present embodiment is a seamless belt. No limitations are therefore imposed on a position on the intermediate transfer belt at which a toner image should be transferred.

However, according to the present embodiment, the respective polarities of the voltages to be applied to the primary transfer rollers 13M to 13K are opposite to those of the voltages employed in the first embodiment. This is intended to prevent the collection of a majority of unnecessary toner from the intermediate transfer belt 30 into the cleaning unit 14M. Because of this constituent feature, the replacement interval for the image forming station 8M (process cartridge) will be commensurate with that of each of the other image forming stations.

As mentioned above, after image formation is completed, or after either the toner density control sequence or the color mismatch control sequence is completed, the first cleaning sequence is carried out in order to remove unnecessary toner from the intermediate transfer belt 30. During consecutive image formation, the second cleaning sequence is carried out in order to remove unnecessary toner from the intermediate transfer belt 30. Thus, the CPU 50 selects either of the first and second cleaning sequences. Therefore, for example, if images are formed consecutively on one hundred transfer media, no disordered images will be produced. A high-quality image can be produced every time.

Moreover, since the CPU selects either of the first and second cleaning sequences, abrasion of the surfaces of the photosensitive drum and intermediate transfer belt can be suppressed. Consequently, the durability of the apparatus can be improved.

According to the first embodiment, the polarity of a voltage to be applied to the transfer rollers 13M and 13K is the same as the polarity exhibited by normally electrified toner. The polarity of a voltage to be applied to the transfer rollers 13C and 13Y is opposite to the polarity exhibited by normally electrified toner. Thus, unnecessary toner on the transfer/transport belt 7 is transferred onto the photosensitive drum 9. The present invention is not limited to this mode. Likewise, the combination of polarities of voltages to be applied to the primary transfer rollers 13M to 13K is not limited to the one employed in the third embodiment. Namely, any combination will do as long as a voltage of positive polarity is applied to at least one of the (primary) transfer rollers 13M to 13K, and a voltage of negative polarity is applied to at least one of the other transfer rollers.

Moreover, it has been described in relation to the first and second embodiments and the second cleaning sequence employed in the third embodiment that the peripheral speed of the intermediate transfer belt 30 is set higher than that of the photosensitive drum 9. This is intended to improve cleaning efficiency, shorten the time required to collect unnecessary toner, and stabilize the peripheral speed of either the transfer/transport belt 7 or the intermediate transfer belt 30. Alternatively, if reliable cleaning is pursued in trade-off for shortening of the unnecessary toner collection time, the peripheral speed of either the transfer/transport belt 7 or intermediate transfer belt 30 may be set lower than that of the photosensitive drum 9. However, the direction of movement in which the transfer/transport belt 7 or intermediate transfer belt 30 passes through each transfer position is substantially identical to the direction of movement of the photosensitive drum. If the peripheral speed of the intermediate transfer belt 30 is set to be lower than that of the photosensitive drum 9, the area per unit time by which unnecessary toner adheres to the photosensitive drum 9 increases. Consequently, cleaning efficiency is exerted soon, and unnecessary toner can be collected efficiently. In this case, as shown in FIG. 3, the ratio of the difference in peripheral speed between the photosensitive drum 9 and transfer/transport belt 7 (intermediate transfer belt 30) to the peripheral speed of the photosensitive drum 9 should preferably be −6% or less. More preferably, the ratio should be −10% or less.

Assuming that the unnecessary toner collection time is not restricted to any particular value, when a series of cleaning steps is carried out after the completion of image formation, the control unit (CPU) causes the transfer/transport belt 7 or intermediate transfer belt 30 to rotate slower than the photosensitive drum 9. Assuming that the unnecessary toner collection time is restricted to some value, the transfer/transport belt 7 or intermediate transfer belt 30 is rotated more quickly than the photosensitive drum 9. Thus, the control unit switches the rotating speeds at which the transfer/transport belt or intermediate transfer belt is rotated. Cleaning is therefore carried out optimally according to any situation.

Moreover, in the aforesaid embodiments, the normal polarity exhibited by normally electrified toner is defined as negative polarity. The voltage to be applied to each of the (primary) transfer rollers 13M to 13K is either +1.0 kV or −1.5 kV. However, the present invention is not limited to the negative polarity and the voltages of +1.0 kV or −1.5 kV.

In the aforesaid first to third embodiments, the peripheral speed of the photosensitive drum 9, transfer/transport belt 7, or intermediate transfer belt 30 is set to one specific value for ordinary image formation. Alternatively, the peripheral speed of the photosensitive drum 9, transfer/transport belt 7, or intermediate transfer belt 30 to be set for image formation may be varied depending on the kind of transfer medium in consideration of the property thereof concerning fixation of toner. Specifically, the peripheral speed to be set for image formation on a transparent resin medium used exclusively for an overhead projector (OHT) may be set to one-fourth of the peripheral speed to be set for image formation on, for example, plain paper. The peripheral speed to be set for image formation on cardboard may be set to one-third of the peripheral speed to be set for image formation on plain paper.

When the peripheral speed of the transfer/transport belt 7 or intermediate transfer belt 30 is set as mentioned above for image formation, the peripheral speed to be set for cleaning is higher than the peripheral speed to be set for image formation on plain paper.

Furthermore, according to the aforesaid embodiments, the transfer medium bearer and intermediate transfer member are shaped like a belt. Alternatively, they may be shaped like a drum. Nevertheless, the present invention can be applied in the same manner. In this case, for example, color toner images are successively transferred from the image bearers (photosensitive members) onto the transfer medium borne by the transfer medium bearer, and thus superimposed on one another. Similarly, for example, color toner images are successively transferred from the image bearers onto the intermediate transfer member, and thus superimposed on one another. Thereafter, the superimposed color toner images on the intermediate transfer member are transferred all together onto the transfer medium.

The combination of polarities of an applied voltage or the various means or members employed in the embodiments may be varied as long as the variants will not deviate from the idea underlying the present invention.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus, comprising:

a movable image bearing member for bearing a toner image; and a movable transfer medium bearing member for bearing a transfer medium;

wherein a toner image borne by said image bearing member is transferred onto a transfer medium borne by said transfer medium bearing member at a transfer position, and wherein a difference between a moving speed at which said image bearing member passes through the transfer position and a moving speed at which said transfer medium bearing member passes through the transfer position when the toner image on said image bearing member is electrostatically transferred onto the transfer medium is unequal to that when toner on said transfer medium bearing member is electrostatically transferred onto said image bearing member.

2. An image forming apparatus according to claim 1, wherein the difference in moving speed is made larger when the toner on said transfer medium bearing member is transferred onto said image bearing member than when the toner image on said image bearing member is transferred onto the transfer medium.

3. An image forming apparatus according to claim 2, wherein the moving speed at which said transfer medium bearing member passes through the transfer position is made higher when the toner on said transfer medium bearing member is transferred onto said image bearing member than when the toner image on said image bearing member is transferred onto the transfer medium borne by said transfer medium.

4. An image forming apparatus according to claim 3, wherein the moving speed at which said transfer medium bearing member passes through the transfer position is higher than the moving speed at which said image bearing member passes through the transfer position.

5. An image forming apparatus according to claim 2, wherein the moving speed at which said image bearing member passes through the transfer position is made higher when the toner on said transfer medium bearing member is transferred onto said image bearing member than when the toner image on said image bearing member is transferred onto said transfer medium.

6. An image forming apparatus according to claim 5, wherein the moving speed at which said image bearing member passes through the transfer position is higher than the moving speed at which said transfer medium bearing member passes through the transfer position.

7. An image forming apparatus according to claim 2, wherein when the toner on said transfer medium bearing member is transferred onto said image bearing member, and when the moving speed at which said image bearing member passes through the transfer position is set equal to A and the moving speed at which said transfer medium bearing member passes through the transfer position is set equal to B, the following relationship is established:

$$(|A-B|/A)\times 100 \geqq 6.$$

8. An image forming apparatus according to claim 7, wherein when the toner image on said image bearing member is transferred onto the transfer medium, and when the moving speed at which said image bearing member passes through the transfer position is set equal to A and the moving speed at which said transfer medium bearing member passes through the transfer position is set equal to B, the following relationship is established:

$$(|A-B|\times A)\times 100\leqq 3.$$

9. An image forming apparatus according to claim 2, wherein when the toner on said transfer medium bearing member is transferred onto said image bearing member, and when the moving speed at which said image bearing member passes through the transfer position is set equal to A and the moving speed at which said transfer medium bearing member passes through the transfer position is set equal to B, the following relationship is established:

$$(|A-B|/A)\times 100\geqq 10.$$

10. An image forming apparatus according to claim 9, wherein when the toner image on said image bearing member is transferred onto the transfer medium, and when the moving speed at which said image bearing member passes through the transfer position is set equal to A and the moving speed at which said transfer medium bearing member passes through the transfer position is set equal to B, the following relationship is established:

$$(A-B|\times A)\times 100\leqq 3.$$

11. An image forming apparatus according to claim 1, wherein when the toner image on said image bearing member is transferred onto the transfer medium, the difference in moving speed is substantially nil.

12. An image forming apparatus according to claim 1, further comprising a transferring means for electrostatically transferring the toner image on said image bearing member onto the transfer medium.

13. An image forming apparatus according to claim 12, wherein said transferring means transfers the toner on said transfer medium bearing member onto said image bearing member.

14. An image forming apparatus according to claim 1, wherein said image bearing member includes a plurality of such image bearing members are provided, and images on said image bearing members are successively transferred onto the transfer medium and thus superimposed on one another.

15. An image forming apparatus according to claim 14, wherein a direction of an electric field induced for transferring toner on said transfer medium bearing member onto a first image bearing member at a first transfer position is opposite to a direction of an electric field induced for transferring toner on said transfer medium bearing member onto a second image bearing member at a second transfer position.

16. An image forming apparatus according to any of claims 1–15, further comprising a collecting means for collecting toner on said image bearing member, wherein toner transferred from said transfer medium bearing member onto said image bearing member is collected by said collecting means.

17. An image forming apparatus, comprising:

a movable image bearing member for bearing a toner image; and a movable intermediate transfer member;

wherein a toner image on said image bearing member is transferred onto said intermediate transfer member at a transfer position, and then the toner image on said intermediate transfer member is transferred onto a transfer medium, and wherein a difference between a moving speed at which said image bearing member passes through the transfer position and a moving speed at which said intermediate transfer member passes through the transfer position when the toner image on said image bearing member is electrostatically transferred onto said intermediate transfer member is unequal to that when toner on said intermediate transfer member is electrostatically transferred onto said image bearing member.

18. An image forming apparatus according to claim 17, wherein the difference in moving speed is made larger when the toner on said intermediate transfer member is transferred onto said image bearing member than when the toner image on said image bearing member is transferred onto said intermediate transfer member.

19. An image forming apparatus according to claim 18, wherein the moving speed at which said intermediate transfer member passes through the transfer position is made higher when the toner on said intermediate transfer medium is transferred onto said image bearing member than when the toner image on said image bearing member is transferred onto said intermediate transfer member.

20. An image forming apparatus according to claim 19, wherein the moving speed at which said intermediate transfer member passes through the transfer position is higher than the moving speed at which said image bearing member passes through the transfer position.

21. An image forming apparatus according to claim 18, wherein the moving speed at which said image bearing member passes through the transfer position is made higher when the toner on said intermediate transfer member is transferred onto said image bearing member than when the toner image on said image bearing member is transferred onto said intermediate transfer member.

22. An image forming apparatus according to claim 21, wherein the moving speed at which said image bearing member passes through the transfer position is higher than the moving speed at which said intermediate transfer member passes through the transfer position.

23. An image forming apparatus according to claim 18, wherein when the toner on said intermediate transfer member is transferred onto said image bearing member, and when the moving speed at which said image bearing member passes through the transfer position is set equal to A and the moving speed at which said intermediate transfer member passes through the transfer position is set equal to B, the following relationship is established:

$$(|A-B|/A)\times 100\geqq 6.$$

24. An image forming apparatus according to claim 23, wherein when the toner image on said image bearing member is transferred onto said intermediate transfer member, and when the moving speed at which said image bearing member passes through the transfer position is set equal to A and the moving speed at which said intermediate transfer member passes through the transfer position is set equal to B, the following relationship is established:

$$(|A-B|/A)\times 100\leqq 3.$$

25. An image forming apparatus according to claim 18, wherein when the toner on said intermediate transfer member is transferred onto said image bearing member, and when the moving speed at which said image bearing member passes through the transfer position is set equal to A and the moving speed at which said intermediate transfer member passes through the transfer position is set equal to B, the following relationship is established:

$$(|A-B|/A)\times 100 \geqq 10.$$

26. An image forming apparatus according to claim 25, wherein when the toner image on said image bearing member is transferred onto said intermediate transfer member, and when the moving speed at which said image bearing member passes through the transfer position is set equal to A and the moving speed at which said intermediate transfer member passes through the transfer position is set equal to B, the following relationship is established:

$$(|A-B|/A)\times 100 \leqq 3.$$

27. An image forming apparatus according to claim 17, further comprising a transferring means for electrostatically transferring the toner image on said image bearing member onto said intermediate transfer member.

28. An image forming apparatus according to claim 27, wherein said transferring means transfers the toner image on said intermediate transfer member onto said image bearing member.

29. An image forming apparatus according to claim 17, further comprising an electrifying means for electrifying toner on said intermediate transfer member so that the toner will exhibit polarity opposite to polarity exhibited by normally electrified toner, wherein the toner on said intermediate transfer member electrified by said electrifying means is electrostatically transferred onto said image bearing member.

30. An image forming apparatus according to claim 29, wherein when images are formed sequentially on a plurality of transfer media, the toner on said intermediate transfer member electrified by said electrifying means is electrostatically transferred onto said image bearing member, and the toner on said image bearing member is transferred onto said intermediate transfer member at the same time.

31. An image forming apparatus according to claim 17, wherein when the toner image on said image bearing member is transferred onto said intermediate transfer member, the difference in moving speed is substantially nil.

32. An image forming apparatus according to claim 17, wherein said image bearing member includes a plurality of such image bearing members are provided, images on said image bearing members are successively transferred onto said intermediate transfer member and thus superimposed on one another, and the images are then transferred from said intermediate transfer member onto the transfer medium.

33. An image forming apparatus according to claim 32, wherein a direction of an electric field induced for transferring toner on said intermediate transfer member onto a first image bearing member at a first transfer position is opposite to a direction of an electric field induced for transferring toner on said intermediate transfer member onto a second image bearing member at a second transfer position.

34. An image forming apparatus according to any of claims 17–33, further comprising a collecting means for collecting toner on said image bearing member, wherein toner transferred from said intermediate transfer member to said image bearing member is collected by said collecting means.

35. An image forming apparatus, comprising:

a movable image bearing member for bearing a toner image; and a movable transfer medium bearing member for bearing a transfer medium;

wherein a toner image on said image bearing member is transferred onto the transfer medium borne by said transfer medium bearing member at a transfer position, and wherein a first mode in which a difference between a moving speed at which said image bearing member passes through the transfer position and a moving speed at which said transfer medium bearing member passes through the transfer position is a first moving speed difference, and toner on said transfer medium bearing member is electrostatically transferred onto said image bearing member, or a second mode in which the difference in moving speed is a second moving speed difference which is larger than the first moving speed difference, and the toner on said transfer medium bearing member is electrostatically transferred onto said image bearing member, is selected.

36. An image forming apparatus according to claim 35, wherein the second moving speed difference is larger than the difference in moving speed when the toner on said image bearing member is transferred onto the transfer medium.

37. An image forming apparatus according to claim 36, wherein the first moving speed difference is substantially identical to the difference in moving speed when the toner on said image bearing member is transferred onto the transfer medium.

38. An image forming apparatus according to claim 37, wherein said first moving speed difference is substantially nil.

39. An image forming apparatus according to claim 36, wherein the moving speed of said transfer medium bearing member in the second mode is made higher when the toner on said transfer medium bearing member is transferred onto said image bearing member than when the toner image on said image bearing member is transferred onto the transfer medium.

40. An image forming apparatus according to claim 39, wherein the moving speed at which said transfer medium bearing member passes through the transfer position is higher than the moving speed at which said image bearing member passes through the transfer position.

41. An image forming apparatus according to claim 36, wherein the moving speed of said image bearing member in the second mode is made higher when the toner on said transfer medium bearing member is transferred onto said image bearing member than when the toner image on said image bearing member is transferred onto the transfer medium.

42. An image forming apparatus according to claim 41, wherein the moving speed at which said image bearing member passes through the transfer position is higher than the moving speed at which said transfer medium bearing member passes through the transfer position.

43. An image forming apparatus according to claim 35, wherein when said second mode is selected, when the moving speed at which said image bearing member passes through the transfer position is set equal to A and the moving speed at which said transfer medium bearing member passes through the transfer position is set equal to B, the following relationship is established:

$$(|A-B|/A)\times 100 \geqq 6.$$

44. An image forming apparatus according to claim 43, wherein when the first mode is selected, when the moving speed at which said image bearing member passes through the transfer position is set equal to A and the moving speed at which said transfer medium bearing member passes through the transfer position is set equal to B, the following relationship is established:

$$(|A-B|\times A)\times 100\leqq 3.$$

45. An image forming apparatus according to claim 35, wherein when said second mode is selected, when the moving speed at which said image bearing member passes through the transfer position is set equal to A and the moving speed at which said transfer medium bearing member passes through the transfer position is set equal B, the following relationship is established:

$$(|A-B/A)\times 100\geqq 10.$$

46. An image forming apparatus according to claim 45, wherein when the first mode is selected, when the moving speed at which said image bearing member passes through the transfer position is set equal to A and the moving speed at which said transfer medium bearing member passes through the transfer position is set equal to B, the following relationship is established:

$$(|A-B|/A)\times 100\leqq 3.$$

47. An image forming apparatus according to claim 35, further comprising a transferring means for electrostatically transferring the toner image on said image bearing member onto the transfer medium.

48. An image forming apparatus according to claim 47, wherein said transferring means transfers the toner on said transfer medium bearing member onto said image bearing member.

49. An image forming apparatus according to claim 35, wherein said image bearing member includes a plurality of such image bearing members are provided, and images on said image bearing members are successively transferred onto the transfer medium and thus superimposed on one another.

50. An image forming apparatus according to claim 49, wherein a direction of an electric field induced for transferring toner on said transfer medium bearing member onto a first image bearing member at a first transfer position is opposite to a direction of an electric field induced for transferring toner on said transfer medium bearing member onto a second image bearing member at a second transfer position.

51. An image forming apparatus according to any of claims 35–50, further comprising a collecting means for collecting the toner on said image bearing member, wherein toner transferred from said transfer medium bearing member to said image bearing member is collected by said collecting means.

52. An image forming apparatus, comprising:

a movable image bearing member for bearing a toner image; and an intermediate transfer member;

wherein a toner image on said image bearing member is transferred onto said intermediate transfer member at a transfer position, and then the toner image on said intermediate transfer member is transferred onto a transfer medium, and wherein a first mode in which a difference between a moving speed at which said image bearing member passes through the transfer position and a moving speed at which said intermediate transfer member passes through the transfer position is a first moving speed difference, and the toner on said intermediate transfer member is transferred onto said image bearing member, or a second mode in which the difference in moving speed is a second moving speed difference which is larger than the first moving speed difference, and the toner on said intermediate transfer member is transferred onto said image bearing member is selected.

53. An image forming apparatus according to claim 52, wherein the second moving speed difference is larger than the difference in moving speed when the toner image on said image bearing member is transferred onto said intermediate transfer member.

54. An image forming apparatus according to claim 53, wherein the first moving speed difference is substantially identical to the difference in moving speed when the toner image on said image bearing member is transferred onto said intermediate transfer member.

55. An image forming apparatus according to claim 54, wherein the first moving speed difference is substantially nil.

56. An image forming apparatus according to claim 53, wherein the moving speed of said intermediate transfer member in the second mode is made higher when the toner on said intermediate transfer member is transferred onto said image bearing member than when the toner image on said image bearing member is transferred onto said intermediate transfer member.

57. An image forming apparatus according to claim 56, wherein the moving speed at which said intermediate transfer member passes through the transfer position is higher than the moving speed at which said image bearing member passes through the transfer position.

58. An image forming apparatus according to claim 53, wherein the moving speed of said image bearing member in the second mode is made higher when the toner on said intermediate transfer member is transferred onto said image bearing member than when the toner image on said image bearing member is transferred onto said intermediate transfer member.

59. An image forming apparatus according to claim 58, wherein the moving speed at which said image bearing member passes through the transfer position is higher than the moving speed at which said intermediate transfer member passes through the transfer position.

60. An image forming apparatus according to claim 52, wherein when the second mode is selected, when the moving speed at which said image bearing member passes through the transfer position is set equal to A and the moving speed at which said intermediate transfer member passes through it is set equal to B, the following relationship is established:

$$(|A-B|/A)\times 100\geqq 6.$$

61. An image forming apparatus according to claim 60, wherein when the first mode is selected, when the moving speed at which said image bearing member passes through the transfer position is set equal to A and the moving speed at which said intermediate transfer member passes through the transfer position is set equal to B, the following relationship is established:

$$(|A-B|/A)\times 100\leqq 3.$$

62. An image forming apparatus according to claim 52, wherein when the moving speed at which said image bearing member passes through the transfer position is set equal to A and the moving speed at which said intermediate transfer member passes through the transfer position is set equal to B, the following relationship is established:

$$(|A-B|/A)\times 100\geqq 10.$$

63. An image forming apparatus according to claim 62, wherein when the first mode is selected, when the moving speed at which said image bearing member passes through the transfer position is set equal to A and the moving speed at which said intermediate transfer member passes through the transfer position is set equal to B, the following relationship is established:

$$(|A-B|/A)\times 100 \leqq 3.$$

64. An image forming apparatus according to claim 52, further comprising a transferring means for electrostatically transferring the toner image on said image bearing member onto said intermediate transfer member.

65. An image forming apparatus according to claim 64, wherein said transferring means electrostatically transfers the toner on said intermediate transfer member onto said image bearing member.

66. An image forming apparatus according to claim 52, further comprising an electrifying means for electrifying toner on said intermediate transfer member so that the toner will exhibit polarity opposite to polarity exhibited by normally electrified toner, wherein the toner on said intermediate transfer member electrified by said electrifying means is electrostatically transferred onto said image bearing member.

67. An image forming apparatus according to claim 66, wherein when images are formed sequentially on a plurality of transfer media, the toner on said intermediate transfer member electrified by said electrifying means is electrostatically transferred onto said image bearing member, and the toner image on said image bearing member is transferred onto said intermediate transfer member at the same time.

68. An image forming apparatus according to claim 52, wherein said image bearing member includes a plurality of such image bearing members are provided, and images on said image bearing members are successively transferred onto said intermediate transfer member and thus superimposed on one another, and the images are then transferred from said intermediate transfer member onto the transfer medium.

69. An image forming apparatus according to claim 68, wherein a direction of an electric field included for transferring toner on said intermediate transfer member onto a first image bearing member at a first transfer position is opposite to a direction of an electric field induced for transferring toner on said intermediate transfer member onto a second image bearing member at a second transfer position.

70. An image forming apparatus according to any of claims 52–69, further comprising a collecting means for collecting toner on said image bearing member, wherein toner transferred from said intermediate transfer member onto said image bearing member is collected by said collecting means.

71. An image forming apparatus, comprising:

an image bearing member for bearing a toner image; and a movable transfer medium bearing member for bearing a transfer medium;

wherein the toner image on said image bearing member is transferred onto the transfer medium borne by said transfer medium bearing member at a transfer position, and wherein a moving speed at which said transfer medium bearing member passes through the transfer position when the toner image on said image bearing member is electrostatically transferred onto the transfer medium is unequal to that when toner on said transfer medium bearing member is electrostatically transferred onto said image bearing member.

72. An image forming apparatus according to claim 71, wherein the moving speed at which said transfer medium bearing member passes through the transfer position is made higher when toner on said transfer medium bearing member is electrostatically transferred onto said image bearing member than when the toner image on said image bearing member is electrostatically transferred onto the transfer medium.

73. An image forming apparatus, comprising:

an image bearing member for bearing a toner image; and a movable intermediate transfer member;

wherein the toner image on said image bearing member is transferred onto said intermediate transfer member at a transfer position, and then the toner image on said intermediate transfer member is transferred onto a transfer medium, and wherein a moving speed at which said intermediate transfer member passes through the transfer position when the toner image on said image bearing member is electrostatically transferred onto the intermediate transfer member is unequal to that when toner on said intermediate transfer member is electrostatically transferred onto said image bearing member.

74. An image forming apparatus according to claim 73, wherein the moving speed at which said intermediate transfer member passes through the transfer position is made higher when toner on said intermediate transfer member is electrostatically transferred onto said image bearing member than when the toner image on said image bearing member is electrostatically transferred onto said intermediate transfer member.

* * * * *

UNITED STATES PATENT AND TRADEMARK OFFICE

CERTIFICATE OF CORRECTION

PATENT NO. : 6,385,428 B1
DATED : May 7, 2002
INVENTOR(S) : Michio Uchida et al.

It is certified that error appears in the above-identified patent and that said Letters Patent is hereby corrected as shown below:

Column 1,
Line 28, “superimpose” should read -- superimposes --.
Line 66, should be deleted.

Column 13,
Line 26, “(A-B|xA)x100≤3.” should read -- (|A-B|xA)x100≤3. --.
Line 42, “members are provided,” should read-- members, --.

Column 15,
Line 44, “members are provided,” should read -- members, --.

Column 17,
Line 11, “equal” should read -- equal to --.
Line 34, “members are provided,” should read -- members, --.

Column 19,
Line 32, “members re provided,” should read -- members, --.

Signed and Sealed this

Thirtieth Day of July, 2002

*Attest:*

*Attesting Officer*

JAMES E. ROGAN
*Director of the United States Patent and Trademark Office*